US007044163B1

(12) United States Patent
Fan et al.

(10) Patent No.: US 7,044,163 B1
(45) Date of Patent: May 16, 2006

(54) DRAG REDUCTION IN PIPE FLOW USING MICROBUBBLES AND ACOUSTIC ENERGY

(75) Inventors: Joline Fan, Columbus, OH (US); Zhe Cui, Columbus, OH (US)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 11/054,893

(22) Filed: Feb. 10, 2005

Related U.S. Application Data

(60) Provisional application No. 60/543,172, filed on Feb. 10, 2004.

(51) Int. Cl.
*F15C 1/04* (2006.01)
*F15C 1/08* (2006.01)

(52) U.S. Cl. ..... 137/828; 137/826

(58) Field of Classification Search ..... 137/826, 137/828

See application file for complete search history.

(56) References Cited

U.S. PATENT DOCUMENTS 3,030,773 A * 4/1962 Johnson ..... 60/749
4,736,912 A 4/1988 Loebert
5,613,456 A * 3/1997 Kuklinski ..... 114/67 A
5,647,433 A * 7/1997 Sasaki ..... 165/148
5,961,895 A 10/1999 Sanford
6,279,611 B1 * 8/2001 Uematsu et al. ..... 137/888
6,357,374 B1 3/2002 Moore et al.
6,435,214 B1 * 8/2002 Babenko ..... 137/810
2003/0097971 A1 * 5/2003 Takahashi ..... 114/67 A
2003/0146523 A1 * 8/2003 Morse et al. ..... 261/79.2

OTHER PUBLICATIONS

Atsuhide Kitagawa et al.; Turbulence Structures of Microbubble Flow Measured by PIV/PTV and LIF Techniques; 2002.

Y.A. Hassan et al.; Experimental Study of Micro-buble Drag Reduction Using Particle Image Velocimetry; 2002.

* cited by examiner

*Primary Examiner*—A. Michael Chambers
(74) *Attorney, Agent, or Firm*—Dinsmore & Shohl LLP

(57) ABSTRACT

Methods and apparatus for reducing drag in fluid flow through pipes that utilizes microbubbles and acoustic energy are provided. A gas ejector for microbubble generation in a pipe is provided and includes a pipe comprising a wall having inner and outer diameters and at lease one orifice in the wall for ejecting gas microbubbles into the pipe. To cause the formation of the microbubbles, a flow restrictor is provided in the pipe, with the flow restrictor being spaced from the inner diameter of the pipe wall and positioned adjacent the at least one orifice. The flow restrictor causes and increase in the velocity of the fluid in the pipe past the at least one orifice, and produces a pressure drop which draws gas into the orifice. That gas is then ejected into the pipe in the form of microbubbles. Acoustic energy may be used to provide further reductions in drag.

32 Claims, 4 Drawing Sheets

Calibration of gas entrainment vs. liquid flow

Pressure Reduction without ejector protrusion

Pressure Drop with ejector protrusion

DRAG REDUCTION IN PIPE FLOW USING MICROBUBBLES AND ACOUSTIC ENERGY

CROSS-REFERENCE TO RELATED APPLICATIONS

This application claims the benefit of U.S. Provisional Application Ser. No. 60/543,172, filed Feb. 10, 2004, the entire disclosure of which is hereby incorporated by reference.

BACKGROUND OF THE INVENTION

The present invention relates to methods and apparatus for reducing drag in fluid flow through pipes, and more particularly to a gas ejector and a method of using a gas ejector to provide microbubbles to reduce fluid drag in pipe flow.

Fluid flow in a pipe or a channel occurs ubiquitously in domestic or industrial settings. Flow can be driven by pumps providing a pressure head that overcomes the wall friction or the drag in the flow. For a given flow rate, an increase in pressure head requires an increase in pumping energy, causing a corresponding increase in the cost of operation. Thus, for a given flow rate, a decrease in drag force, resulting in a decrease in pressure head, is a desired operating strategy. Drag reduction for liquid flow in a pipe or channel flow is commonly achieved by adding chemicals such as surfactants or polymers to the liquid. Through the formation of surfactant micelles or polymer chains in the bulk liquid, the frequency of formation and size of the turbulence eddies can be dampened. This results in the boundary layer in the pipe wall becoming less turbulent, resulting in less drag in the liquid flow.

While the use of chemicals is effective in reducing drag, the chemicals can be costly and environmentally unfriendly. One approach for drag reduction is to render the wall boundary layer to be more "slippery," allowing fluid to be more effectively transported across the wall surface coupled with damping of turbulence eddies yielding a flow to be more laminar. The concept of using microbubbles to reduce the skin friction of a surface has been reported in the literature for ship hull applications. The flow velocities in these applications are typically high at from 4 to 20 m/sec and are normally in the Reynolds number range of $0.3\times10^6$ to $1.6\times10^6$. Reynolds number is a dimensionless number that is an indicator of the type of fluid flow, either laminar, transitional, or turbulent. Generally, Reynolds numbers of less than about 2500 are indicative of laminar fluid flow. Ship hull applications using microbubbles for drag reduction occur at rather high relative solid surface velocities over an infinite stationary liquid. Also, liquid turbulence decreases quickly at relatively short distances from the hull surface.

In a significantly different fluid flow condition, pipe flow occurs at rather low relative liquid flow velocities over a stationary solid surface with liquids well confined by the solid surface and with turbulence occurring throughout the liquid medium during flows. Very little, however, is known about the role of microbubbles and their drag reducing effects in a pipe flow. Specifically, the mechanism of the microbubble drag reduction phenomenon and microbubble-wall interactions are not understood well enough to allow proper design and operation of microbubble systems for a pipe flow with flow velocities of less than about 4 m/sec and in Reynolds numbers of less than about $1.0\times10^6$.

Accordingly, there remains a need for methods and apparatus for reducing drag in fluid flow through pipes that are cost effective and environmentally friendly.

SUMMARY OF THE INVENTION

The present invention meets that need by providing methods and apparatus for reducing drag in fluid flow through pipes that utilizes microbubbles. In accordance with one aspect of the invention, a gas ejector for microbubble generation in a pipe is provided and includes a pipe comprising a wall having inner and outer diameters and at least one orifice in the wall for ejecting gas microbubbles into the pipe. To cause the formation of the microbubbles, a flow restrictor is provided in the pipe, with the flow restrictor being spaced from the inner diameter of the pipe wall and positioned adjacent the at least one orifice. The flow restrictor causes and increase in the velocity of the fluid in the pipe past the at least ore orifice, and produces a pressure drop which draws gas into the orifice. That gas is then ejected into the pipe in the form of microbubbles.

In a preferred form, the gas ejector includes a plurality of orifices in the pipe wall. For example, the gas ejector may include four orifices spaced substantially equidistantly around the periphery of the pipe. To provide microbubble formation, the orifices have diameters in the range of from between about 50 to about 400μ, and more preferably in the range of from about 100 to about 300μ.

In one embodiment, the flow restrictor comprises a solid body having a diameter of from about 0.5 to about 3.0 mm less than the inner diameter of the pipe wall. In one form, the flow restrictor has a length to diameter ratio of from about 5:1 to about 10:1. Typically, the flow restrictor is comprised of a polymer or metal. The choice of the material of construction for the flow restrictor will depend on the particular fluid flowing through the pipe. However, generally, the choice will be to use materials which are inert to the fluid flowing through the pipe. Either or both of the downstream- and upstream-facing ends of the flow restrictor may be tapered to minimize turbulence.

In order to enhance the drag reduction properties of the gas sector, an acoustic transducer may be positioned in or on the pipe. For example, the acoustic transducer may be positioned against the exterior wall of the pipe. In a preferred form, the acoustic transducer may be wrapped around at least a portion of the exterior wall of the pipe.

The gas ejector may be used in fluid-carrying pipes where the pipes are oriented substantially vertically or substantially horizontally. For vertical fluid flow, the acoustic transducer may be positioned within the pipe in the fluid. For pipes that are oriented substantially horizontally, the acoustic transducer may be positioned downstream from the at least one orifice in the pipe wall. For lengthy pipe runs, it may be advantageous to position a number of gas ejectors along the length of pipe. The gas ejector may be in the form of a modular pipe section that can be connected in line with a pipe carrying fluid.

In accordance with another embodiment of the present invention, a gas ejector assembly for microbubble generation in a pipe is provided and includes a first pipe section having first and second ends and a wall having with a first outer diameter and a second pipe section having first and second ends and a wall having a second outer diameter. The second outer diameter is larger than the first outer diameter such that a plate may be positioned to secure the second end of the first pipe section to the first end of the second pipe section. The plate includes a plurality of openings therein;

and a gas ejector extends through each of the openings in the plate and into the second pipe section.

As described above, the gas ejector comprises a pipe having a wall, with at least one orifice in the wall for ejecting gas microbubbles into the pipe. There is a flow restrictor in the pipe, with the flow restrictor being spaced from the inner diameter of the pipe wall and positioned adjacent the at least one orifice. In a preferred form, the assembly includes a number of gas ejectors, typically four gas ejectors. The gas ejectors may be spaced substantially equidistantly around the outer diameter of the first pipe section.

In another embodiment, a method of generating microbubbles to reduce fluid drag for fluids flowing through a pipe is provided and comprises flowing a fluid through a pipe and providing at least one gas inlet in the pipe. The gas inlet has a size adapted to create microbubbles. A pressure drop adjacent the at least one gas inlet is created by positioning g a flow restrictor in the pipe adjacent the at least one gas inlet. The flow restrictor is spaced from the inner wall of the pipe. A source of gas is provided to the gas inlet to form microbubbles as the gas enters the pipe through the at least one gas inlet.

In a preferred form, a plurality of gas inlets are provided in the pipe. Typically, the gas inlets have diameters of from between about 50 to about 400 p, and preferably from between about 100 to about 300 p. Optionally, acoustic energy may be applied to the fluid in said pipe to cause the microbubbles to move away from the pipe wall.

Accordingly, it is a feature of embodiments of the present invention to methods and apparatus for reducing drag in fluid flow through pipes that are cost effective and environmentally friendly. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which:

FIG. 7 shows a chaotic bubble pattern in the absence of acoustic energy, while FIG. 8 shows an organized bubble pattern when acoustic energy is applied.

DETAILED DESCRIPTION OF THE PREFERRED EMBODIMENTS

Fluid flow in a pipe or a channel occurs ubiquitously in domestic or industrial settings. Flow can be driven by pumps providing a pressure head that overcomes the wall friction or the drag in the flow. Thus, to effect energy savings, it is desirable to reduce the drag force of the fluid through the pipe, Less drag, and thus a decrease in pressure head, leads to a decrease in required pumping energy. Conventional approaches for drag reduction in pipe flow have been the addition of chemicals such as surfactants or polymers to the liquid. Through the formation of surfactant micelles or polymer chains in the bulk liquid, drag reduction may be achieved. However, such additional chemicals may be expensive, both in the costs to add them to the liquid as well as the costs of removing them from the liquid.

We use a gas ejector that entrains gas from the atmosphere and reduces it to microbubbles through a high shear effect of the liquid flow past the ejector. The microbubbles are injected into the wall region, the vortical region, or any desired region of the pipe flow. Preferably, the bubble sizes range from about 50 to about 400μ, and most preferably from about 100 to about 300μ in diameter. Microbubbles in this size range dampen turbulence eddies in the pipe and provide a more "slippery" or more laminar boundary layer in the wall region of the pipe. Such microbubbles can be easily generated even with small amounts of liquid flow with only a negligible pressure drop across the ejector.

Furthermore, the bubble concentration can be easily controlled by decreasing the orifice size in the ejector and/or increasing the liquid flow rate in the pipe. Fluid drag reductions of up to 30% have been obtained. Even greater reductions in drag may be achieved by adjusting the ejector operating conditions.

Figure 1:
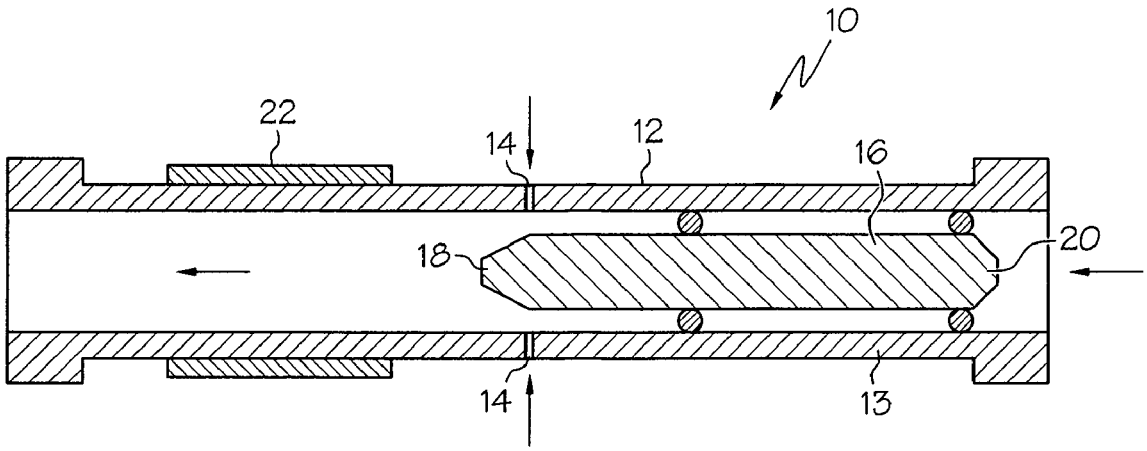
FIG. 1 is a schematic side view of one embodiment of the gas ejector.

Referring initially to FIG. 1, one embodiment of a gas ejector 10 for generating microbubbles in a pipe is illustrated. Gas ejector 10 comprises a pipe 12 having a wall 13 with inner and outer diameters. Gas ejector 10 includes at least one orifice 14 in pipe wall 13 for ejecting gas microbubbles into fluid flowing through pipe 12. Typically, more than one orifice 14 will be provided to insure that sufficient bubble formation is achieved to effect drag reduction. For example, a typical arrangement could be four orifices 14 spaced equidistantly around the periphery of pipe 12.

A flow restrictor 16 is positioned in pipe 12 such that the flow restrictor is spaced from the inner diameter of pipe wall 13. Flow restrictor 16 is also positioned so that its downstream end 18 is adjacent to orifices 14. As shown, both the downstream end 18 and upstream end 20 of the flow restrictor include tapered ends. Flow restrictor 16 may be secured in place in pipe 12 using any of a number of conventional techniques including the use of spacers 24, bolts, screws, or other types of fasteners (not shown).

The pipe diameter and the size and placement of the orifices, as well as the size and placement of the flow restrictor can be tailored to produce microbubble sizes that range from about 50 to about 400μ and to provide concentrations of bubbles in the fluid of up to about 2 vol. %. The fluid flow past the orifices in the ejector is of a sufficient velocity to yield a pressure drop that causes gas to be entrained in the flowing fluid. The high shear of the fluid flow disintegrates the entrained gas into microbubbles which are injected into the pipe flow fluid. In its simplest form, orifices 14 are open to the atmosphere, and atmospheric air is entrained. However, it is also within the scope of the invention to provide a gas under pressure to the orifices. For example, in applications where the fluid flowing through the pipe is sensitive to certain gases such as oxygen, a supply of an inert gas may be used.

Figure 2:
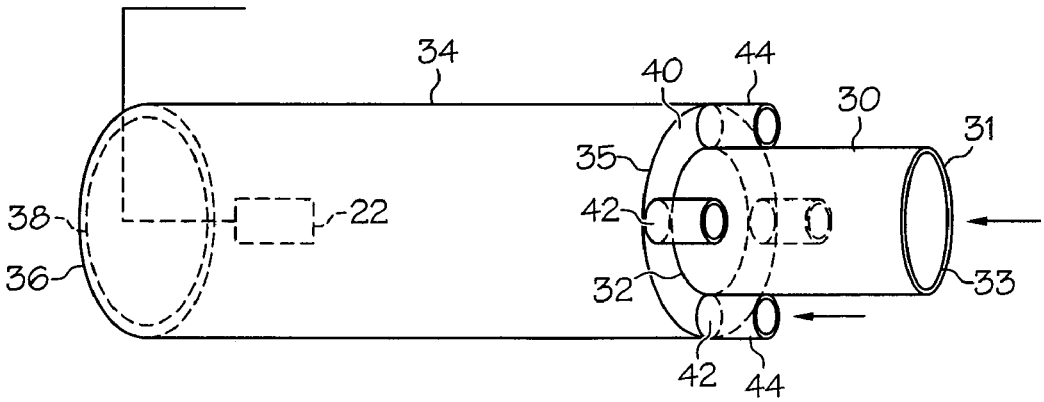
FIG. 2 is a schematic perspective view of another embodiment of the gas ejector showing a multiple gas ejector assembly.

Referring now to FIG. 2, a gas ejector assembly is shown which includes multiple individual gas ejectors having a construction as described with respect to FIG. 1 above. As shown, the gas ejector assembly includes a first pipe section 30 having first and second ends 31 and 32, respectively, and a wall 33 having a first outer diameter. A second pipe section 34 has first and second ends 35 and 36, respectively, and a wall 38 having a second outer diameter. The second outer diameter is larger than the first outer diameter. A plate 40 secures the second end 32 of the first pipe section 30 to the first end 35 of second pipe section 34. Plate 40 includes a plurality of openings 42, with four being depicted.

Gas ejectors 44 extend through each of the openings 42 in plate 40 and into second pipe section 34. The gas ejectors 44 may be mounted so that their respective ends either extend into pipe section 34, or are mounted flush with plate 40. Each ejector 44 has a construction as previously described with respect to the gas ejector shown in FIG. 1. While gas ejectors 44 may vary in number and spacing, in FIG. 2, the ejectors are spaced substantially equidistantly around the periphery of pipe section 30.

Referring back to FIG. 1, in certain preferred embodiments, flow restrictor 16 comprises a solid body having a diameter of from about 0.5 to about 3.0 mm less than the inner diameter of the pipe wall. In one form, the flow restrictor has a length to diameter ratio of from about 5:1 to about 10:1. Typically, the flow restrictor is comprised of a polymer or metal. The choice of the materials of construction for the flow restrictor will depend on the particular fluid flowing through the pipe. However, generally, the choice will be to use materials which are inert to the fluid flowing through the pipe. As shown, either or both of the downstream- and upstream-facing ends of the flow restrictor may be tapered to minimize turbulence.

Figure 3:
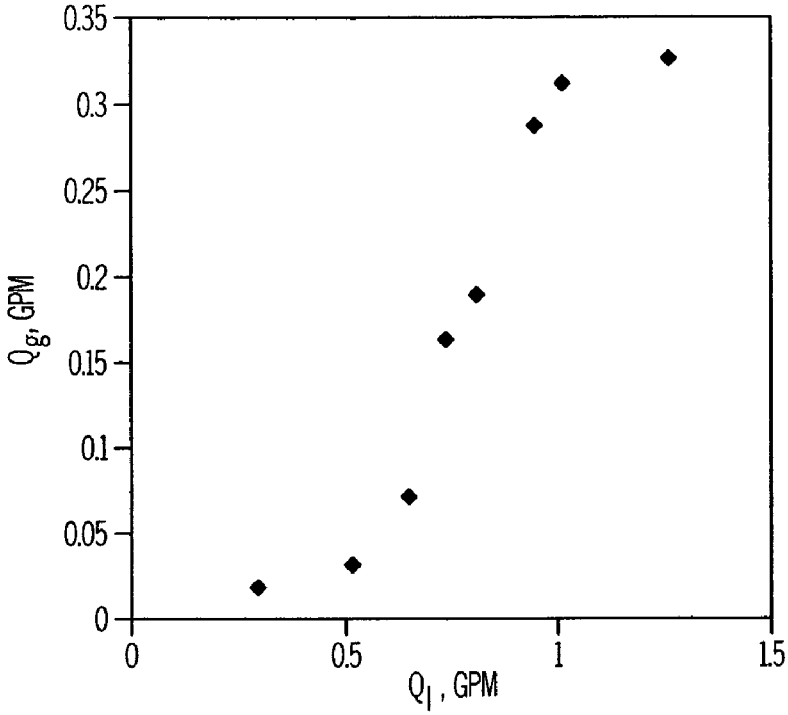
FIG. 3 is a graph of gas entrainment versus liquid flow for an embodiment of the gas ejector.

The gas ejector as described is effective to entrain a significant amount of microbubbles. A correlation of gas entrainment with the liquid flow through a pipe is shown in FIG. 3. In one example, when applying the gas ejector for liquid flow through a pipe, the gas entrainment rate was measured to be 0.05–0.1 gallon/min (GPM) yielding an air concentration in the flow system of 0.7–1.3 vol. % for a 30 GPM liquid flow with four ejectors placed as shown in FIG. 2. The four ejectors are spaced 90° apart around the periphery of the pipe.

Figure 4:
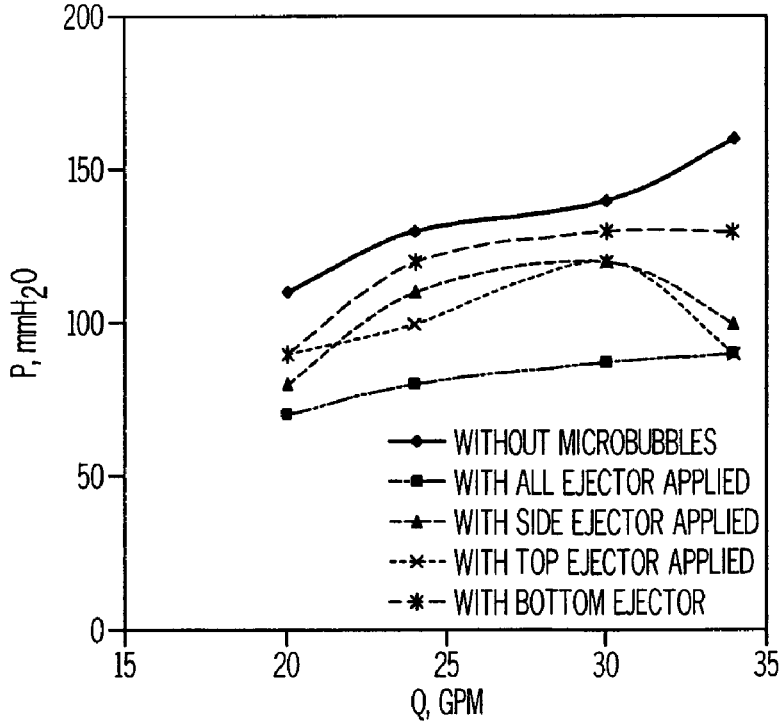
FIG. 4 is a graph of measured pressure reduction without gas ejector protrusion into a pipe section for the embodiment depicted in FIG. 2.
Figure 5:
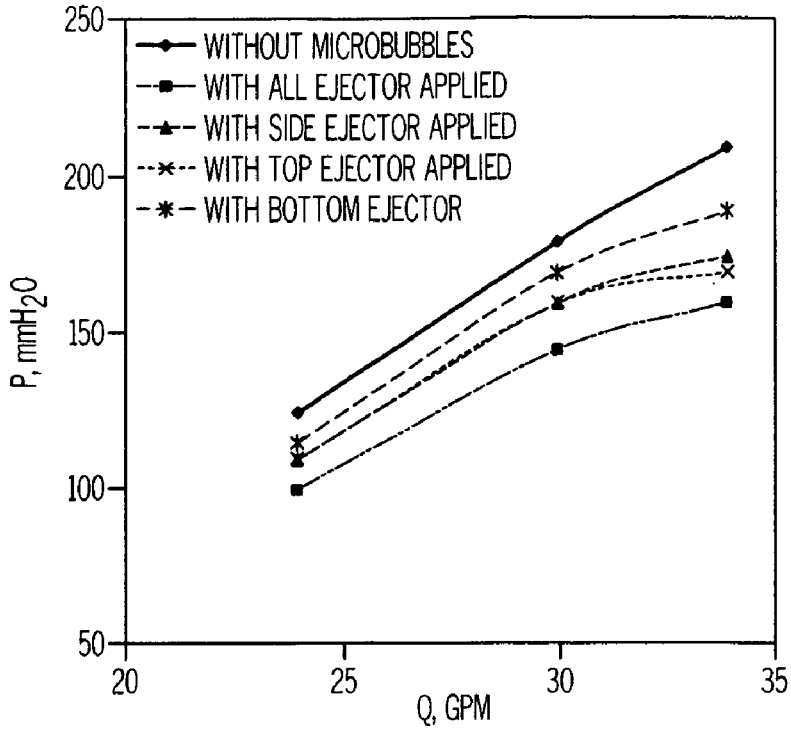
FIG. 5 is a graph of measured pressure reduction with gas ejector protrusion into a pipe section for the embodiment depicted in FIG. 2.
Figure 6:
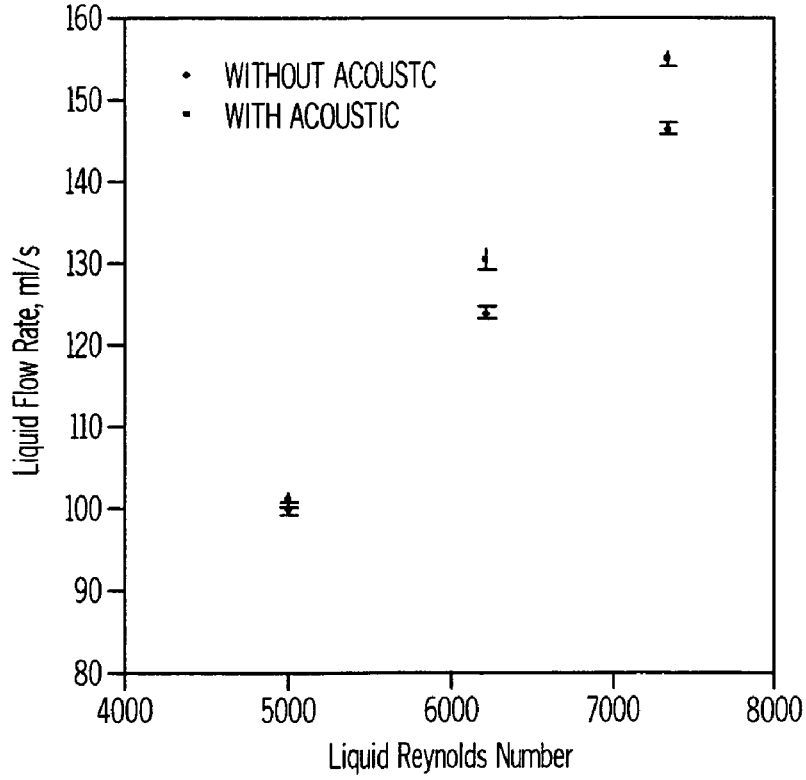
FIG. 6 is a graph comparing liquid flow rates versus measured Reynolds number both with and without the application of acoustic energy to a pipe.

For the gas ejectors as described, the bubble size generated was measured to be about 100–300μ. Using the gas ejector assembly as shown in FIG. 2, pressure variations in the liquid flow rate are shown in FIGS. 4 and 5 for conditions without ejector protrusion and with ejector protrusion, respectively. Ejector protrusion allows microbubbles to be introduced to the inner pipe near the wall region. FIGS. 4 and 5 show the results with either one of the four ejectors applied or all of them applied. FIG. 6 illustrates the effect of the application of acoustic energy on liquid flow rate for varying Reynolds numbers. It can be seen that as much as 30% drag reduction is achieved using the gas ejectors.

In another embodiment of the invention, acoustic waves are utilized to regulate the motion of the microbubbles (e.g., 50–400μ) and mesobubbles (e.g., 2–8 mm), thereby promoting the performance of the bubbling system in reducing drag. We have found that using acoustic waves in a pipe can control the movement of microbubbles and mesobubbles by pushing bubbles to an advantageous location in pipe flows to reduce liquid drag. Furthermore, using acoustic waves in a pipe enhances the interfacial phenomena of microbubbles and results in an improved transport property including drag reduction for the microbubble flows. As shown in FIG. 1, an acoustic transducer 22 may be positioned on the wall of pipe 12. As shown, the transducer 22 may be wrapped partially or completely around the circumference of the pipe. Alternatively, as shown in the embodiment of FIG. 2, an acoustic transducer 22 may be placed in the pipe and actuated using an electrical cable connection. We have found that acoustic waves are useful for both substantially vertical as well as substantially horizontal fluid flow in pipes.

An example of a suitable acoustic transducer is a nickel magnetostrictive oscillator that generates accelerating forces at 16 kHz and 20 kHz. The transducer is silver-brazed to a 10 cm diaphragm plate which vibrates when the transducer is powered. The power ranges up to 600 W. The transducer is analogous to solid state pistons that have counteracting motions perpendicular to the plane of the plate. While the magnitude of these vibrations is small, i.e., only one or two thousandths of an inch, strong accelerating forces are involved, compressing and rarefying the liquid flowing through the pipe. Both the transducer and the power supply are commercially available from Advanced Sonic Processing Systems.

When an acoustic field is activated at 16 kHz and 30 W, microstreams of bubbles may be observed. Cavitated bubbles having an average size of about 300μ in diameter are presented at standing wave nodes. Pressure fluctuation signals were measured under conditions with and without the acoustic field. It was observed that the magnitude of the pressure fluctuation without an acoustic field which is primarily induced by the motion of bubbles, is significantly smaller than that with an acoustic field, signifying that the flow field is regulated by the acoustic waves.

Figure 7:
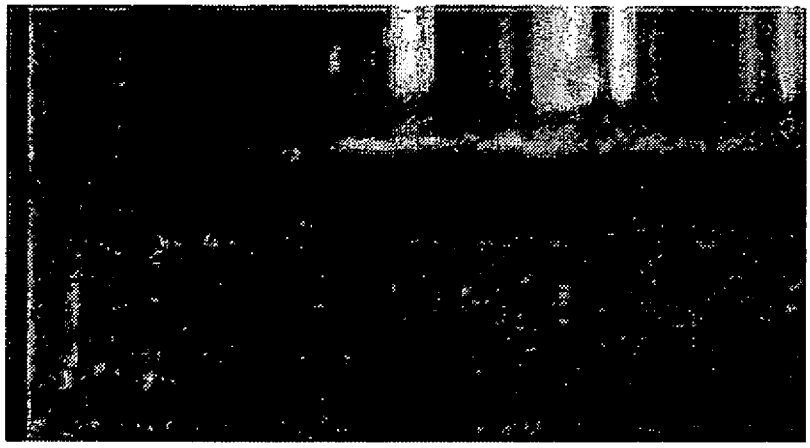
FIGS. 7 and 8 are photographs showing the effect of the application of acoustic energy on liquid flowing through a horizontal vessel.
Figure 8:
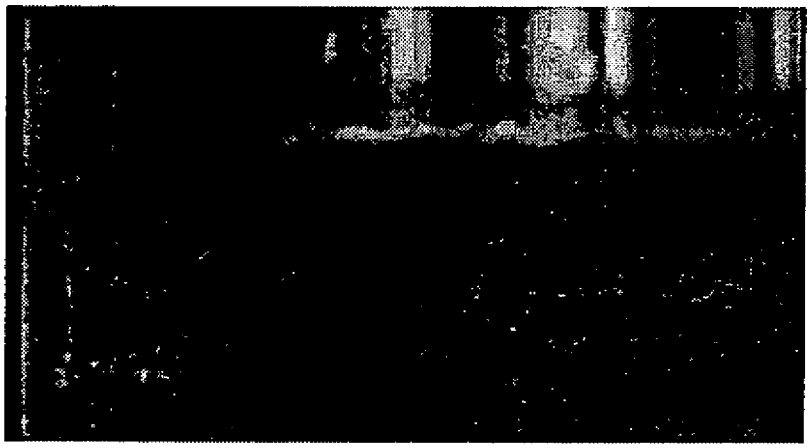

FIGS. 7 and 8 illustrate that the application of acoustic energy to microbubbles and mesobubbles in liquid pipe flow can cause the structure to change from chaotic (FIG. 7) to organized (FIG. 8). The organized bubble flow behavior results in an increased liquid flow rate and demonstrates a reduction in drag. Referring to FIG. 6, it can be seen that for a measured liquid flow rate of 125 ml/sec without the application of acoustic energy for a given gas-liquid flow, the measured liquid flow rate increased to 130 ml/sec when acoustic energy was applied. Without the application of acoustic energy, gas bubbles tend to aggregate in the direction of the upper pipe wall, whereas with the application of acoustic energy, the gas bubble flow is more streamlined and organized and moves away from the wall region of the pipe. This results in lower wall drag and an increased liquid flow rate. These results demonstrate that microbubble and mesobubble motion in liquid pipe flow can be regulated to achieve a flow pattern that results in improved drag reduction.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A gas ejector for microbubble generation in a pipe comprising, a pipe comprising a wall having inner and outer diameters, at least one orifice in said wall for ejecting gas microbubbles into said pipe, and a flow restrictor in said pipe, said flow restrictor being spaced from said inner diameter of said pipe wall and positioned adjacent said at least one orifice.

2. A gas ejector as claimed in claim 1 including a plurality of orifices in said pipe wall.

3. A gas ejector as claimed in claim 2 in which the diameter of said orifices is from between about 50 to about 400μ.

4. A gas ejector as claimed in claim 2 in which the diameter of said orifices is from about 100 to about 300μ.

5. A gas ejector as claimed in claim 1 in which said flow restrictor comprises a solid body having a diameter of from about 0.5 to about 3.0 mm less than the inner diameter of said pipe wall.

6. A gas ejector as claimed in claim 5 in which said flow restrictor has a length to diameter ratio of from about 5:1 to about 10:1.

7. A gas ejector as claimed in claim 5 in which said flow restrictor is comprised of a polymer or metal.

8. A gas ejector as claimed in claim 5 in which the downstream-facing end of said flow restrictor is tapered.

9. A gas ejector as claimed in claim 5 in which the upstream-facing end of said flow restrictor is tapered.

10. A gas ejector as claimed in claim 1 further including an acoustic transducer positioned in or on said pipe.

11. A gas ejector as claimed in claim 10 in which said acoustic transducer is positioned against the exterior wall of said pipe.

12. A gas ejector as claimed in claim 11 in which said acoustic transducer is wrapped around at least a portion of the exterior wall of said pipe.

13. A gas ejector as claimed in claim 10 in which said pipe is oriented substantially vertically and said acoustic transducer is positioned within said pipe.

14. A gas ejector as claimed in claim 10 in which said acoustic transducer is positioned downstream from said at least one orifice in said pipe wall.

15. A gas ejector assembly for microbubble generation in a pipe comprising, a first pipe section having first and second ends and a wall having with a first outer diameter; a second pipe section having first and second ends and a wall having a second outer diameter, said second outer diameter being larger than said first outer diameter; a plate for securing said second end of said first pipe section to said first end of said second pipe section, said plate including a plurality of openings therein; and a gas ejector extending through each of said openings in said plate and into said second pipe section, said gas ejector comprising a pipe having a wall, at lease one orifice in said wall for ejecting gas microbubbles into said pipe, and a flow restrictor in said pipe, said flow restrictor being spaced from the inner diameter of said pipe wall and positioned adjacent said at least one orifice.

16. A gas ejector assembly as claimed in claim 15 including four gas ejectors.

17. A gas ejector assembly as claimed in claim 16 in which said gas ejectors are spaced substantially equidistantly around said first outer diameter of said first pipe section.

18. A gas ejector assembly as claimed in claim 15 in which the diameter of said orifices is from between about 50 to about 400μ.

19. A gas ejector assembly as claimed in claim 18 in which the diameter of said orifices is from about 100 to about 300μ.

20. A gas ejector assembly as claimed in claim 15 in which said flow restrictor comprises a solid body having a diameter of from about 0.5 to about 3.0 mm less than the inner diameter of said pipe wall.

21. A gas ejector as claimed in claim 20 in which said flow restrictor has a length to diameter ratio of from about 5:1 to about 10:1.

22. A gas ejector assembly as claimed in claim 20 in which said flow restrictor is comprised of a polymer or metal.

23. A gas ejector assembly as claimed in claim 20 in which the downstream-facing end of said flow restrictor is tapered.

24. A gas ejector assembly as claimed in claim 20 in which the upstream-facing end of said flow restrictor is tapered.

25. A gas ejector assembly as claimed in claim 15 further including an acoustic transducer positioned in or on said second pipe section.

26. A gas ejector as claimed in claim 25 in which said acoustic transducer is positioned against the exterior wall of said second pipe section.

27. A gas ejector as claimed in claim 26 in which said acoustic transducer is wrapped around at least a portion of the exterior wall of said second pipe section.

28. A method of generating microbubbles to reduce fluid drag for fluids flowing through a pipe comprising, flowing a fluid through a pipe, providing at least one gas inlet in said pipe, said gas inlet having a size adapted to create microbubbles, creating a pressure drop adjacent said at least one gas inlet by positioning a flow restrictor in said pipe adjacent said at least one gas inlet, said flow restrictor being spaced from the inner wall of said pipe, and providing a source of gas to said gas inlet, said gas forming microbubbles as said gas enters said pipe through said at least one gas inlet.

29. A method as claimed in claim 28 including a plurality of gas inlets in said pipe.

30. A method as claimed in claim 29 in which said gas inlets have diameters of from between about 50 to about 400μ.

31. A method as claimed in claim 29 in which said gas inlets have diameters of from between about 100 to about 300μ.

32. A method as claimed in claim 29 including applying acoustic energy to the fluid in said pipe to cause said microbubbles to move away from said pipe wall.

* * * * *